US005161888A

United States Patent [19]

Hauck

[11] Patent Number: 5,161,888

[45] Date of Patent: Nov. 10, 1992

[54] DUAL SHAFT PRECONDITIONING DEVICE HAVING DIFFERENTIATED CONDITIONING ZONES FOR FARINACEOUS MATERIALS

[75] Inventor: Bobbie W. Hauck, Sabetha, Kans.

[73] Assignee: Wenger Manufacturing, Inc., Sabetha, Kans.

[21] Appl. No.: 766,057

[22] Filed: Sep. 26, 1991

[51] Int. Cl.[5] ..... B01F 7/04; B01F 7/06

[52] U.S. Cl. ..... 366/299; 366/300; 366/330

[58] Field of Search ..... 366/297, 298, 299, 300, 366/301, 97, 327, 329, 330, 325

[56] References Cited

U.S. PATENT DOCUMENTS

| | | | |
|---|---|---|---|
| 2,017,116 | 10/1935 | Bonnell | 366/327 |
| 3,901,482 | 8/1975 | Kieffaber | 366/330 |
| 4,329,069 | 5/1982 | Graham | 366/330 |
| 4,752,139 | 6/1988 | Hauck | 366/301 |

*Primary Examiner*—Robert W. Jenkins

*Attorney, Agent, or Firm*—Hovey, Williams, Timmons & Collins

[57] ABSTRACT

A preferred preconditioning device for use with an extruder includes two juxtaposed, frustocylindrical, intercommunicated chambers one of which presents a greater cross-sectional area than the other. A respective pair of rotatably driven mixing shafts extend axially through corresponding chambers with each mixing shaft having a plurality of mixing elements coupled therewith. The mixing elements are arranged, in order to present in cooperation with the chambers, a plurality of conditioning zones preferably including a mixing zone for initially mixing the material, an intermediate retention zone providing increased retention time for enhancing equilibration between solid and liquid portions of the material, and a final tertiary zone for comminuting clumps of material.

6 Claims, 3 Drawing Sheets

DUAL SHAFT PRECONDITIONING DEVICE HAVING DIFFERENTIATED CONDITIONING ZONES FOR FARINACEOUS MATERIALS

BACKGROUND OF THE INVENTION

1. Field of the Invention

The present invention relates to a device for preconditioning farinaceous materials such as soy-containing pet foods prior to treatment in an extrusion cooker. More particularly, the device is concerned with a conditioning vessel having two, juxtaposed, frustocylindrical chambers and respective axially mounted, rotatably driven, mixing shafts having mixing elements extending therefrom and configured to present sequential, differentiated, conditioning zones.

2. Description of the Prior Art

Preconditioners are widely used in combination with extruders for preparing and blending food materials before further processing and cooking in an extruder. For example, products having a relatively high percentage of flour-like material are often blended with water and treated with steam in a preconditioner prior to extrusion. Use of preconditioners is particularly advantageous in preparing products composed of farinaceous material such as pet food containing a relatively large percentage of soy flour.

Some prior art preconditioning devices include an elongated vessel having a pair of identical side-by-side, frustocylindrical, intercommunicated mixing chambers. Each chamber is provided with an axially mounted shaft having mixing elements extending radially outwardly therefrom. The mixing elements are configured for advancing the material from an inlet end of the vessel toward an outlet end and for sweeping the material around the frustocylindrical walls to cause exchange of material between chambers.

A series of liquid inlets are often provided along at least a portion of the length of preconditioning vessels for adding water or other liquid such as fat to the food material during advancement through the mixing chambers. Obviously, it is highly important that any liquid introduced into a preconditioning vessel become thoroughly and uniformly blended with farinaceous material to avoid formation of clumps. Typically, clumps represent a nonhomogeneous mixture of the material and liquid wherein the material forming the outer surface of the clump presents the highest percentage of moisture. Proper blending of liquid with farinaceous materials requires both proper mixing or agitation of the liquid and materials, and sufficient residence time within the preconditioning vessel to ensure equilibration.

Increasing the rotational speed of the mixing elements of conventional preconditioners in an attempt to increase agitation within the vessel causes the material to pass through the vessel at a greater speed which correspondingly reduces the residence time of the material within the vessel to unacceptable levels. On the other hand, reducing the rotational speed of the beaters to increase residence time within the vessel can adversely affect the mixing characteristics of the vessel to the point where proper blending of the material with liquid may not be achieved.

Furthermore, increasing the overall length of the vessel is not desirable because of mechanical problems associated with longer mixing shafts. Moreover, the structural nature of conventional preconditioning devices may not provide operational flexibility for preconditioning different materials at varying flow rates.

U.S. Pat. No. 4,752,139, which is hereby incorporated by reference, discloses a preconditioning apparatus which provides operational flexibility and improved preconditioning in many circumstances. It has been found, however, that some mixtures do not receive both adequate mixing and retention time in the '139 apparatus.

SUMMARY OF THE INVENTION

The present invention solves the prior art problems outlined above by the provision of a preconditioning device which incorporates both operational flexibility along with adequate mixing and retention time. That is to say, the preconditioning device hereof ensures that a wide variety of materials can be preconditioned with improved blending, equilibration and communication of clumps.

The preferred preconditioning device broadly includes a vessel having two juxtaposed, frustocylindrical chambers, a respective pair of mixing shafts axially aligned through corresponding chambers with each shaft presenting a plurality of mixing elements extending therefrom. The chambers and mixing elements are configured to define a plurality of conditioning zones, including a mixing zone adjacent to the vessel inlet for ensuring proper blending of the material, and a downstream retention zone providing a reduced flow rate and thereby increased residence time for enhancing equilibration of solid and liquid portions of the material.

In preferred forms, a tertiary zone downstream of the retention zone provides increased agitation relative to the retention zone in order to ensure adequate communication of material clumps. It is also preferred that some of the mixing elements be configured in sets of three arranged in a helical pattern about the associated shaft. In another embodiment, adjacent sets of mixing elements present respective left and right hand helical patterns which enhances the agitation and residence time of material passing through the vessel.

DETAILED DESCRIPTION OF THE PREFERRED EMBODIMENT

Figure 2:
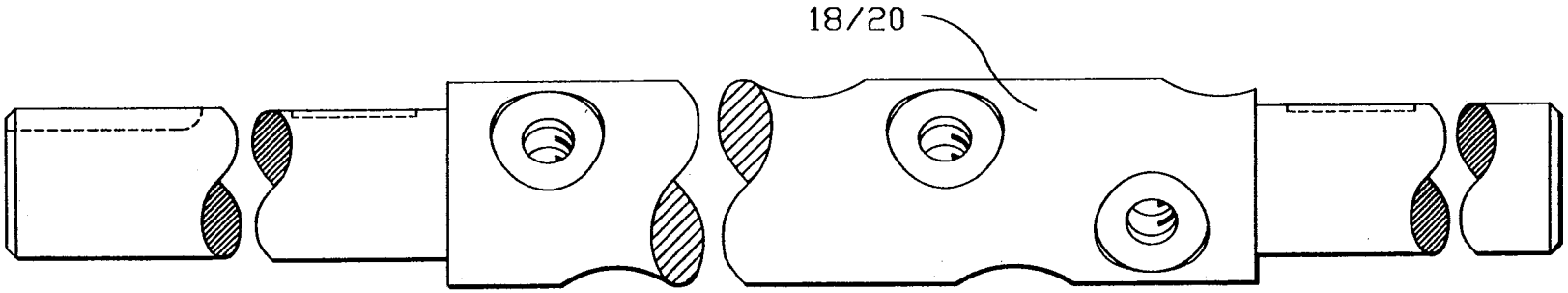
FIG. 2, is a discontinuous, side elevational view, of a rotatable shaft showing end portions thereof and threaded openings for receiving mixing elements.
Figure 1:
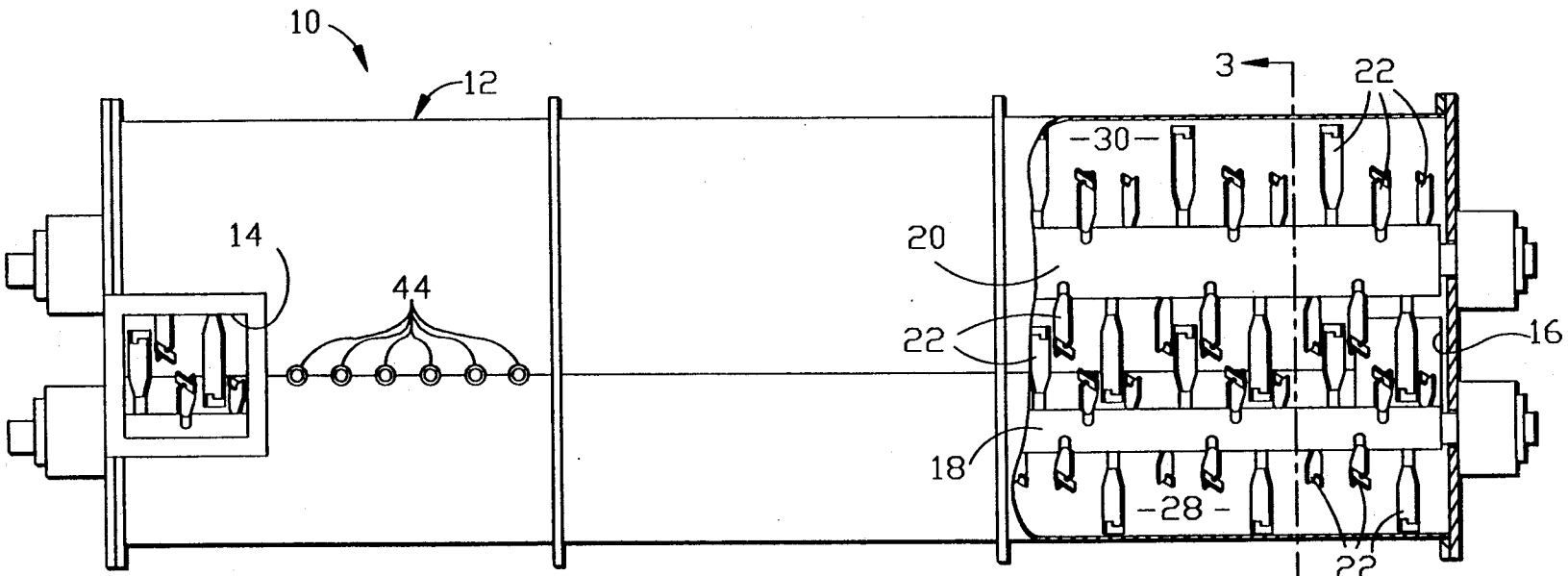
FIG. 1, is a plan view of the preferred preconditioning device of the present invention with portions of the top cover cut away to illustrate a portion of the interior.

The drawing figures illustrate the preferred embodiment of preconditioning device 10 which includes an elongated conditioning vessel 12, and upwardly opening inlet 14, downwardly opening outlet 16, rotatably driven mixing shafts 18 and 20 with each having a plurality of mixing elements threadably secured thereto and particularly including mixing beaters 22 and mixing paddles 24.

Figure 10:
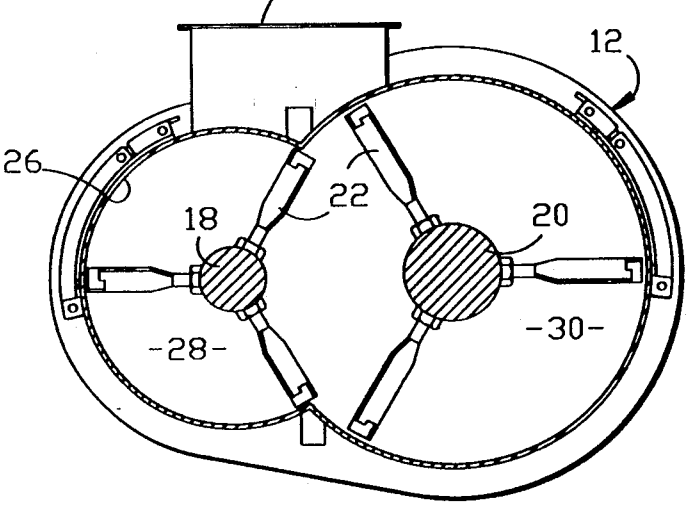
FIG. 10, is a sectional view of the device taken along line 10—10 of FIG. 7.
Figure 3:
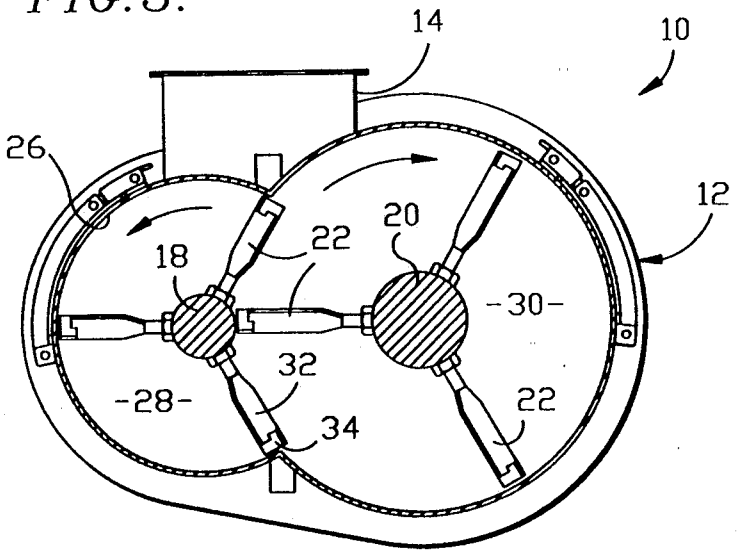
FIG. 3, is a sectional view of the device taken along line 3—3 of FIG. 1.

Referring now to FIGS. 3 and 10, vessel 12 includes elongated, transversely arcuate walls 26 presenting a first, frustocylindrical, smaller mixing chamber 28, and a second, frustocylindrical, larger mixing chamber 30. Chambers 28,30 are juxtaposed and intercommunicate with each other. Larger chamber 30 presents a greater cross sectional area than that of chamber 28. Preferably, the radius of curvature of large chamber 30 is one and one-half times as great as the radius of curvature of smaller chamber 28.

Mixing shaft 18 is centered along the longitudinal axis of smaller chamber 28 and, in the preferred embodiment, presents a plurality of beaters 22 secured at longitudinally and angularly spaced locations along the length thereof, and thus, along the length of smaller chamber 28. A conventional drive (not shown) is coupled with shaft 18 in order to impart counter-clockwise rotation thereto as viewed in FIGS. 3 and 10.

Each of beaters 22 includes an elongated, relatively flat member 32, variously inclined to advance or inhibit conveyance of material along smaller chamber 28 as shaft 18 rotates. Additionally, flat members 32 are also variously oriented to pass material into larger chamber 30. The outer most regions of beaters 22 present a T-shaped configuration by means of a relatively short, flat head 34 affixed to the outer end of each respective member 32 in transverse relationship therewith. As can best be seen in FIGS. 3 and 10, beaters 22 extend radially outwardly from shaft 18 and terminate in close proximity to walls 26.

Mixing shaft 20 presents a larger diameter than shaft 18 and is axially positioned within larger chamber 30. As with shaft 18, a conventional drive imparts rotation thereto, but arranged for clockwise rotation as viewed in FIGS. 3 and 10.

Shaft 20 carries a plurality of longitudinally spaced beaters 22 and paddles 24, all of which extend radially outwardly from shaft 20 and terminate closely adjacent walls 26. Each paddle 24 includes a relatively flat mixing member 36 inclined relative to the rotational axis of shaft 20 in various orientations to enhance or retard conveyance of material along chamber 30 and to exchange material with smaller 28.

Figure 4:
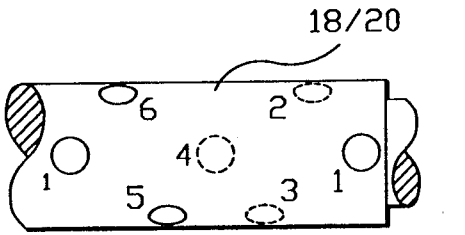
FIG. 4, is a partial elevational view of a rotatable shaft illustrating the placement of threaded openings for receiving mixing elements with adjacent sets of three thereof in left hand and right hand helical configurations.
Figure 5:
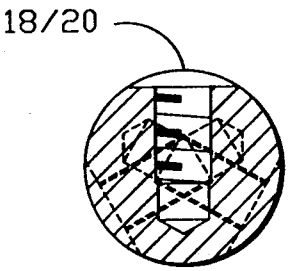
FIG. 5, is a diagram illustrating the angular spacing between the mixing elements of FIG. 4.
Figure 6:
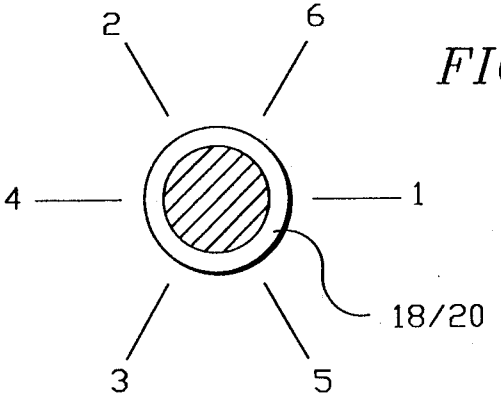
FIG. 6, is an end sectional view of a rotatable shaft of the device illustrating a threaded opening for receiving a mixing element with two other threaded openings shown in dashed lines to illustrate the angular spacing.
Figure 9:
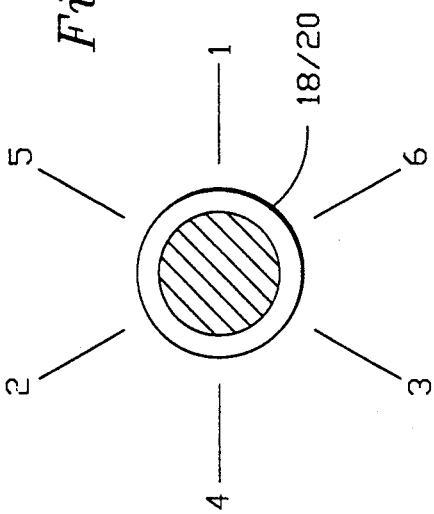
FIG. 9, is a diagram illustrating the angular spacing of the mixing elements of FIG. 8.
Figure 8:
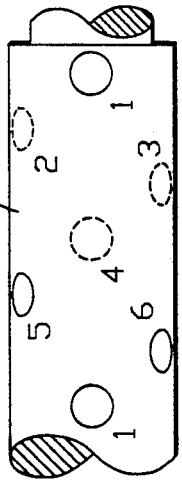
FIG. 8, is a partial elevational view of a rotatable shaft illustrating the placement of threaded openings for receiving mixing elements with adjacent sets of three thereof in a right hand helical pattern.
Figure 7:
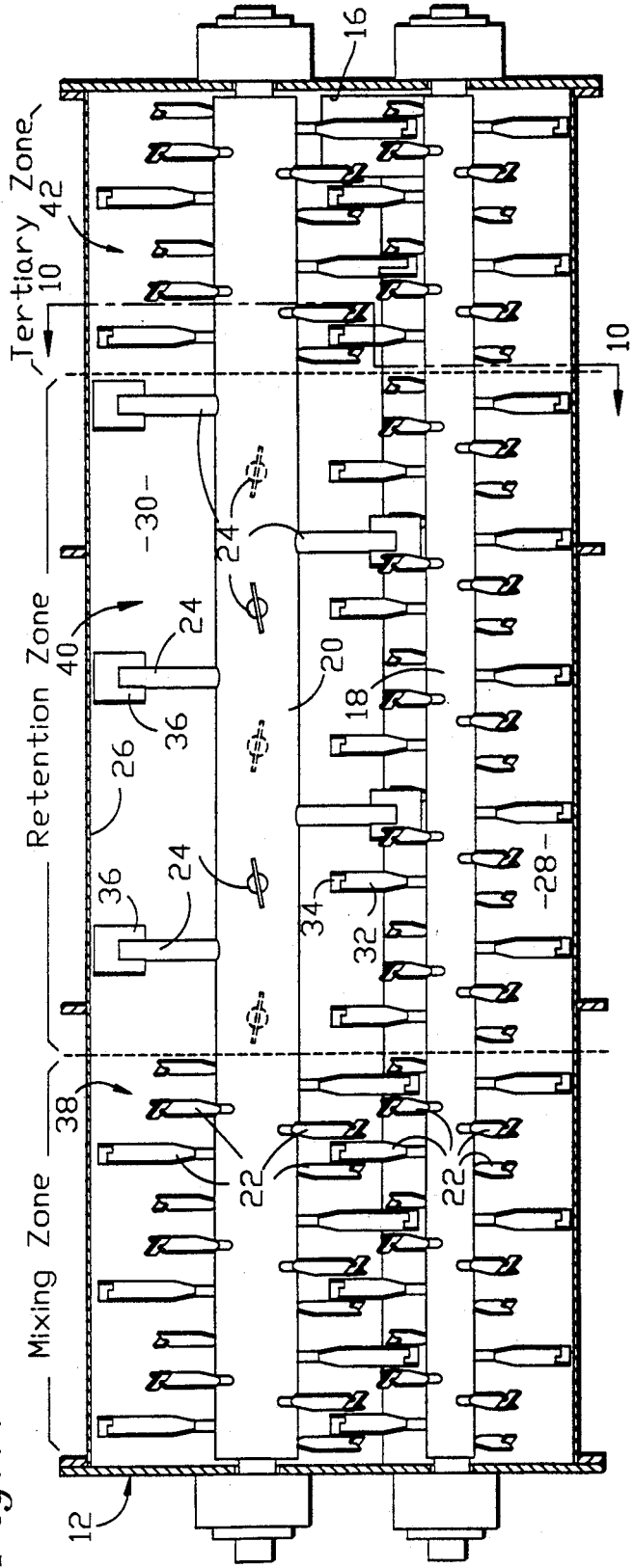
FIG. 7, is a top plan view of the device with the top cover removed illustrating the internal arrangement of chambers, shafts, and mixing elements forming three conditioning zones.

As best viewed in FIG. 7, beaters 22 are arranged in sets of three with beaters 22 in any one set angularly spaced by 120 and longitudinally spaced relative to the radius of the shaft with which the beaters are coupled. In one embodiment adjacent sets of beaters are arranged in a right hand helical pattern as illustrated in FIGS. 4,5 and 7 for imparting generally downstream conveyance of material from inlet 14 to outlet 16. In another embodiment alternate sets of beaters are arranged in a right hand helical pattern while intervening sets are arranged in a left hand helical pattern, as illustrated in FIGS. 8 and 9. Left hand oriented sets of beaters 22 convey material generally upstream toward inlet 14 in order to reduce the flow rate of material through device 10 and thereby increase the retention time.

In the preferred embodiment, shaft 18 rotates at twice the speed of shaft 20. This rotational speed in cooperation with the angular and longitudinal spacing of beaters 22 and paddles 24 coordinates the motion of these mixing elements so that elements in chambers 28 and 30 mesh with one another.

Paddles 24 are threadably coupled with shaft 20 at an angular spacing of 90° as illustrated in FIG. 7. The preferred arrangement of beaters 22 and paddles 24 cooperate with the configuration of chambers 28 and 30 to present three conditioning zones—mixing zone 38, retention zone 40, and tertiary zone 42.

Mixing zone 38 includes six sets of three beaters 22 on each of shafts 18 and 20. In retention zone 40, ten sets of three beaters are included only on shaft 18 with ten corresponding paddles 24 including on shaft 20. In tertiary zone 42, four sets of three beaters are included on each of shafts 18 and 20. With this preferred configuration, the longitudinal extent of paddles 24 along shaft 20 define the longitudinal limits of retention zone 40, which thereby defines the inboard limits of mixing zone 38 and tertiary zone 42, with the outboard limits thereof defined by the respective vessel ends.

In operation of device 10, material introduced through inlet 14 is first received within mixing zone 38. In this zone liquids can be added through liquid ports 44, defined in the top of vessel 12. As those skilled in the art appreciate, the added liquid is often water or possibly fat, and it is necessary to thoroughly mix the liquid with the farinaceous material. The provision of beaters 22 on both of shafts 18,20, along with the angular orientation of flat member 32 and flat head 34, results in greatly enhanced mixing as compared to the prior art.

After mixing in zone 38, the material being conditioned passes downstream to retention zone 40 to allow equilibration between the liquid and solid portions of the material. The cooperation among the components making up retention zone 40 provide for substantially increased retention time and thereby increased equilibration. Specifically, the inclusion of paddles 24 on shaft 20 and beaters 22 reduces the flow rate of material through zone 40. Additionally, as can be best viewed in FIG. 7, paddle numbers 36 are variously oriented to provide upstream and downstream conveyance. Furthermore, the exchange of material between chambers 28 and 30 also enhances the equilibration while providing ongoing mixing, blending, and agitation.

Finally, the material being conditioned passes downstream from zone 40 and enters tertiary zone 42, which includes sets of beaters 22 on both shafts 18 and 20. These additional beaters, in cooperation with the other components making up zone 42, vigorously agitate the material to comminute any clumps that may have formed during conditioning in zones 38 and 40. This ensures that the material exiting outlet 16 presents a more uniform particulate consistency for subsequent cooking and extrusion.

With reference to FIG. 7, it can also be observed that various ones of beaters 22 on both shafts 18,20 are oriented for downstream and upstream conveyance to achieve the desired flow rates of material through zones 38 42. Thus, the cooperation of beater element type and orientation, rotational speed, chamber shape and exchange of material between chambers in each zone, cooperate to enhance the conditioning capability of device 10. This allows for a wide variety of materials along with added liquids to be properly conditioned for increased product quality, operational flexibility, and lowered capital operational costs.

Having thus described the preferred embodiments of the present invention, the following is claimed as new and desired to be secured by Letters Patent:

I claim:

1. A device for conditioning material such as flour or the like and comprising:

a vessel presenting a pair of elongated, transversely arcuate walls defining a pair of elongated, juxtaposed intercommunicated chambers with one of the chambers having a greater cross-sectional area than the other of the chambers, respective front and rear end walls closing the ends of said chambers and defining the length thereof, and structure defining a material inlet and a spaced material outlet along the length of the vessel and in communication with the chambers;

an elongated, axially rotatable mixing shaft within and generally along the length of each chamber;

a number of elongated, outwardly extending beaters secured to one of said shafts in axially spaced relationship along the length of the one shaft for subjecting said material to relatively intense agitation;

respective first, second and third pluralities of elongated, outwardly extending, material-engaging elements secured to the other of said shafts along corresponding first, second and third elongated sections of said other shaft and oriented for intercalation with adjacent beaters secured to the one shaft, said first plurality comprising beater elements and said first section extending from said front end wall to a point intermediate the ends of the other shaft, said second plurality of comprising paddle elements and said second section extending from said first point to a second point intermediate the ends of the other shaft and closer to the rear wall than the first point, said third plurality comprising beater elements and said third section extending from said second point to the rear end wall, said paddle elements being configured differently than the beaters secured to sad one shaft, and the beater elements secured to said first and third sections of said other shaft, the paddle elements including structure for mixing and relatively less agitation of said material, said second section bearing longer than either of said first and third sections, the total number of said beaters secured to the one shaft being grater than the total number of material-engaging elements secured to the other shaft, the number of paddle elements secured to said second section of said other shaft being smaller than the number of opposed, adjacent beaters on said one shaft in intercalating relationship with the number of paddle elements, said intercalating bearers and material-engaging elements being cooperatively configured for establishing along the length of said vessel a mixing zone, a retention zone and a tertiary zone generally corresponding in length to said first, second and third sections of said other shaft, the retention time of said material in said retention zone being greater than the retention times thereof in said mixing and tertiary zones.

2. The device as set forth in claim 1, at least some of said beaters and beater elements being arranged as a set of members presenting equiangular spacing around a respective shaft in a helical pattern therearound.

3. The device as set forth in claim 2, said set of members being a right hand set with said helical pattern being a right hand helical pattern relative to the direction of rotation of the respective shaft in order to induce downstream conveyance of material through said vessel.

4. The device as set forth in claim 3, at least some of said members being arranged as a left hand set of members presenting equi-angular spacing around the respective shaft in a left hand helical pattern relative to the direction of rotation of the respective shaft in order to induce at least partial upstream conveyance of material for reducing material flow rate.

5. The device as set forth in claim 4, further including a plurality of said right hand sets of members and a plurality of said left hand sets of members.

6. The device as set forth in claim 5, said left and right hand sets of members being alternately arranged.

* * * * *